US008052110B2

(12) United States Patent
Wang

(10) Patent No.: US 8,052,110 B2
(45) Date of Patent: Nov. 8, 2011

(54) TELESCOPICALLY ADJUSTABLE SUPPORT BRACE

(76) Inventor: Dennis H. Wang, Baldwin Park, CA (US)

( * ) Notice: Subject to any disclaimer, the term of this patent is extended or adjusted under 35 U.S.C. 154(b) by 231 days.

(21) Appl. No.: 12/409,588

(22) Filed: Mar. 24, 2009

(65) Prior Publication Data

US 2010/0243849 A1 Sep. 30, 2010

(51) Int. Cl.
*A47F 5/00* (2006.01)

(52) U.S. Cl. ..... 248/354.3; 248/354.1; 52/149; 410/145

(58) Field of Classification Search ..... 248/354.1, 248/354.3, 354.4; 52/146, 149, 150; 135/16, 135/141, 142; 410/143, 152, 153, 145; 403/109.1, 403/109.4, 109.8
See application file for complete search history.

(56) References Cited

U.S. PATENT DOCUMENTS

| | | | | |
|---|---|---|---|---|
| 2,686,649 | A * | 8/1954 | De Vigier | 254/98 |
| 3,210,047 | A * | 10/1965 | Jackson | 254/98 |
| 5,590,863 | A * | 1/1997 | Sasaki | 248/354.3 |
| 6,247,882 | B1 | 6/2001 | Huang | 410/151 |
| 7,290,742 | B2 * | 11/2007 | Wang | 248/200.1 |

* cited by examiner

*Primary Examiner* — A. Joseph Wujciak, III
(74) *Attorney, Agent, or Firm* — Alan Kamrath; Kamrath & Associates PA

(57) ABSTRACT

A telescopically adjustable support brace includes a first member and a second member operably moveable with respect to the first member in a telescopic manner. The first and second members are adapted to be positioned across two objects for maintaining a fixed distance therebetween. A quick-clamping device includes a collar moveably engaged in the first member and a quick-release device for selectively clutching the collar to the second member. When the collar is clutched to the second member, the second member is adapted to be moved with respect to the first member by the collar. Further, an adjusting device is operable to move the collar with respect to the first member, and the collar is thereafter adapted to move the second member with respect to the first member.

11 Claims, 9 Drawing Sheets

TELESCOPICALLY ADJUSTABLE SUPPORT BRACE

BACKGROUND OF THE INVENTION

1. Field of the Invention

The present invention relates to an adjustable brace and, in particular, to a telescopically adjustable support brace for maintaining a fixed distance between two objects.

2. Description of the Related Art

U.S. Pat. No. 6,247,882 shows a bracing device which includes a tube and a rod that is moveably engaged in the tube. Further, a plurality of depressions is formed on the tube. Moreover, a lever is pivotally connected to the tube and includes a pawl for selectively engaging one of the plurality of depressions in order to retain the rod at a predetermined position with respect to the tube. A problem with the bracing device is that cutting the plurality of depressions causes an adverse effect on the structure strength of the rod. Additionally, it involves a great deal of effort and cost to manufacture these depressions. Further, if one of these depressions is not precisely cut and thus in a deviation from alignment of the other depressions, the lever will have a problem to engage into this particular depression. At worst, the lever can no longer engage this particular depression. Another problem is that the bracing device can not be finely adjusted to avoid tilted-positioning across two objects or using a foreign object to recoup a distance between the two objects that exceed the length of the bracing device.

The present invention is, therefore, intended to obviate or at least alleviate the problems encountered in the prior art.

SUMMARY OF THE INVENTION

According to the present invention, a telescopically adjustable support brace includes a first member and a second member moveably engaged in the first member. The second member is operably moveable with respect to the first member in a telescopic manner. The first and second members are adapted to be positioned across two objects for maintaining a fixed distance therebetween. Further, a quick-clamping device includes a collar moveably engaged in the first member, and the collar includes an inner periphery which surrounds and is selectively clutched to the second member by a quick-release device. The quick-release device is engaged with and is operable to move the collar between a tightened position such that the inner periphery of the collar is clutched to the second member and the second member is adapted to be moved with respect to the first member by the collar, and a released position such that the inner periphery of the collar disengages from the second member and the second member is moveable relative to the collar. Further, an adjusting device is engaged with and is operable to move the collar with respect to the first member when the collar is in the tightened position, such that the collar is moved by the adjusting device and the second member is thereafter adapted to be moved with respect to the first member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The present invention will be described with reference to the accompanying drawings which assist in illustrating the pertinent features thereof, in which.

DETAILED DESCRIPTION OF THE PREFERRED EMBODIMENT

Figure 1:
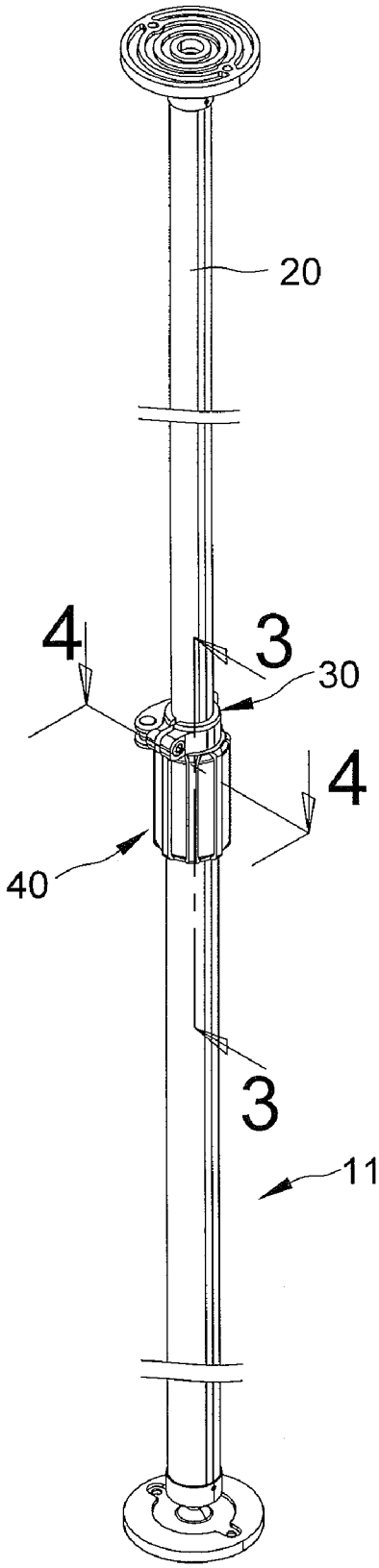
FIG. 1 is a perspective view of a telescopically adjustable support brace in accordance with a first embodiment of the present invention.
Figure 2:
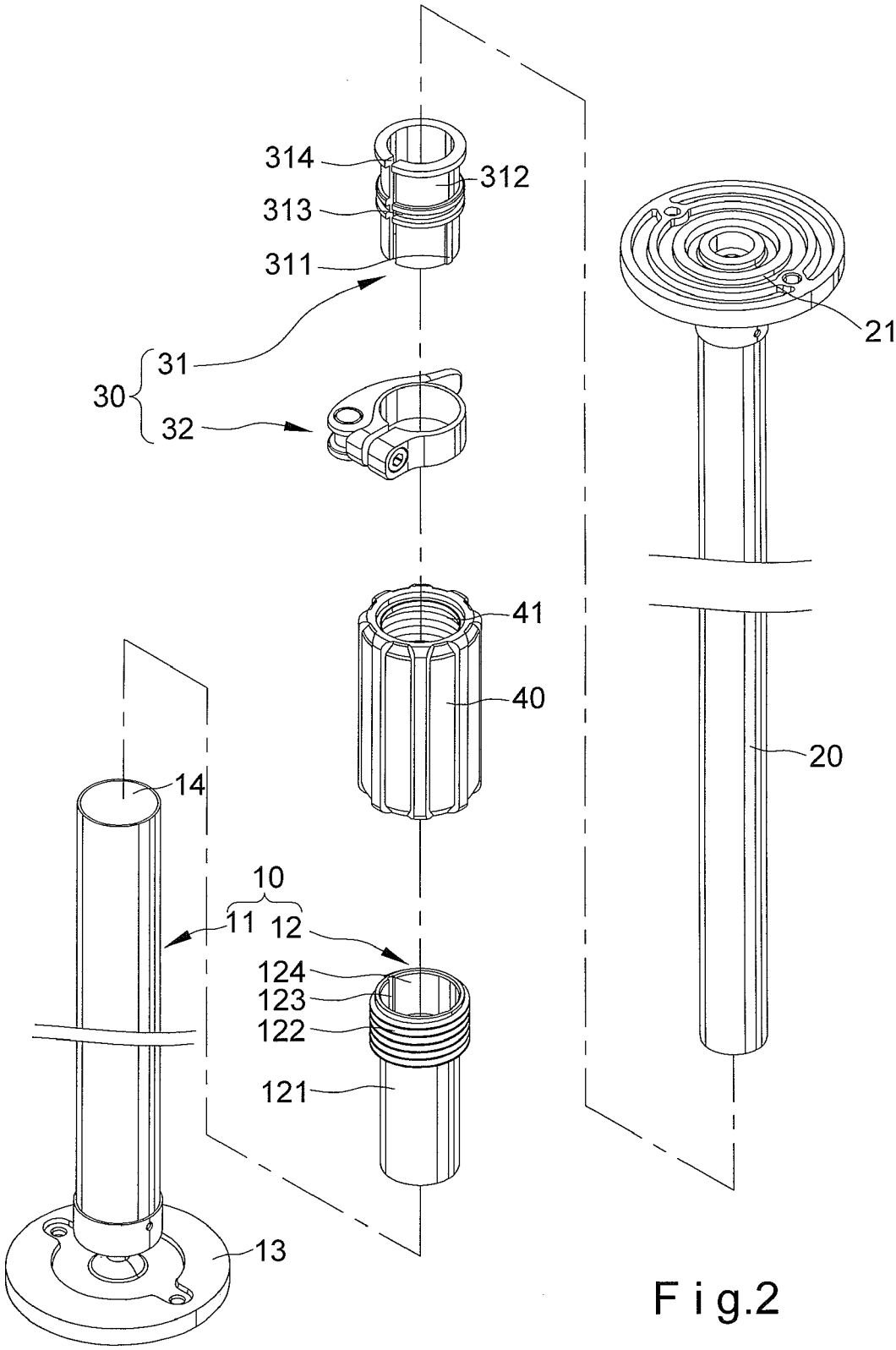
FIG. 2 is an exploded, perspective view of the telescopically adjustable support brace shown in FIG. 1.
Figure 3:
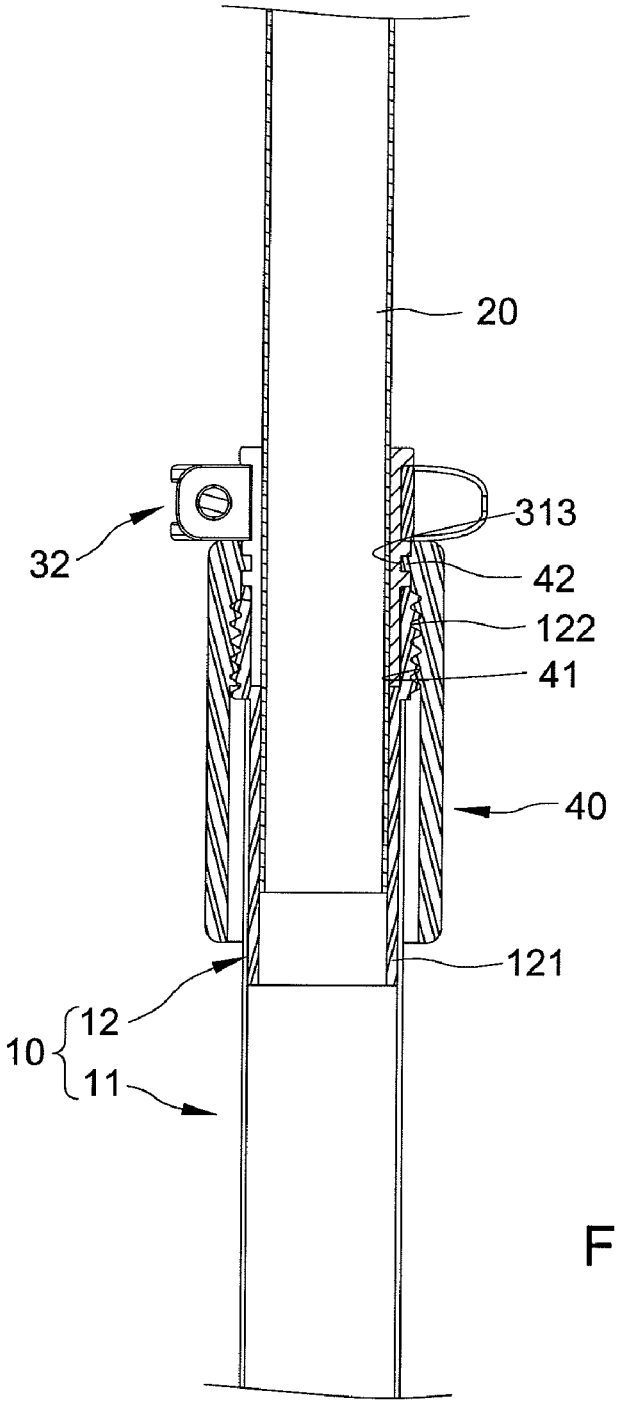
FIG. 3 is a cross-sectional view taken along line 3-3 in FIG. 1.
Figure 4:
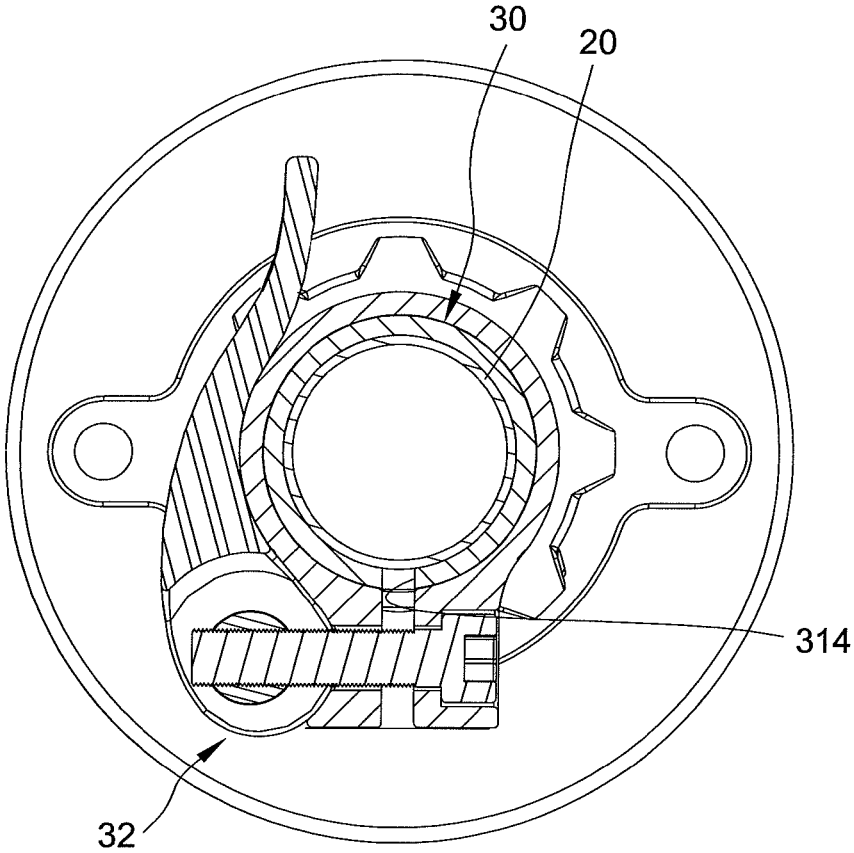
FIG. 4 is a cross-sectional view taken along line 4-4 in FIG. 1.
Figure 5:
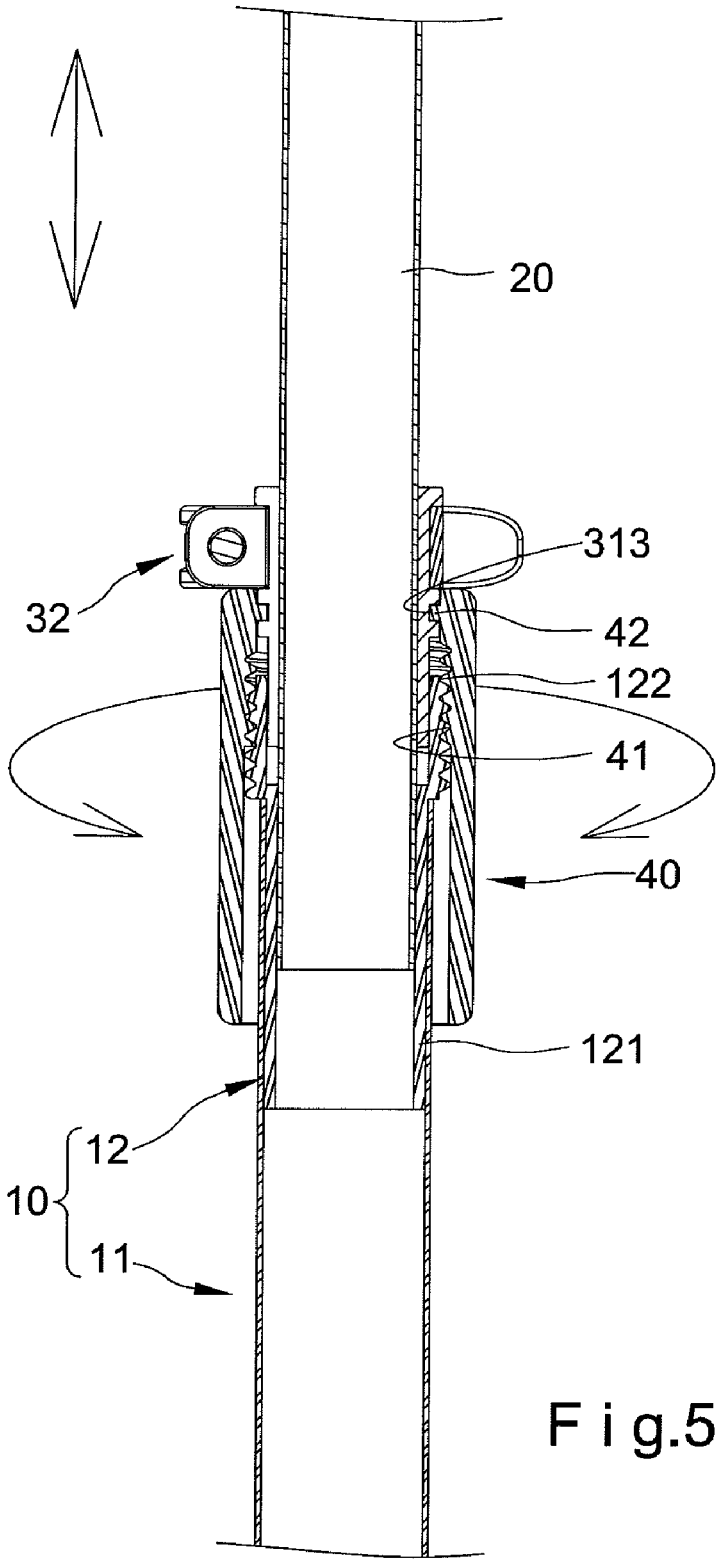
FIG. 5 is a cross-sectional view illustrating operation of the telescopically adjustable support brace shown in FIG. 1.
Figure 6:
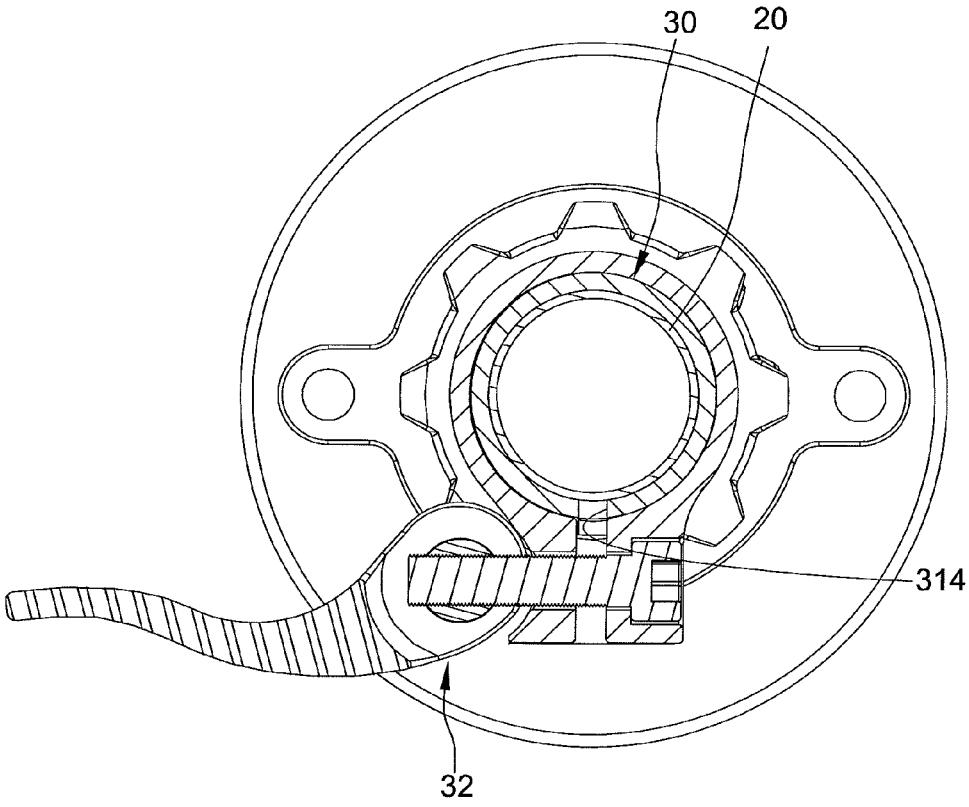
FIG. 6 is an extended cross-sectional view of FIG. 4, showing a quick-clamping device of the telescopically adjustable support brace in a released position.
Figure 7:
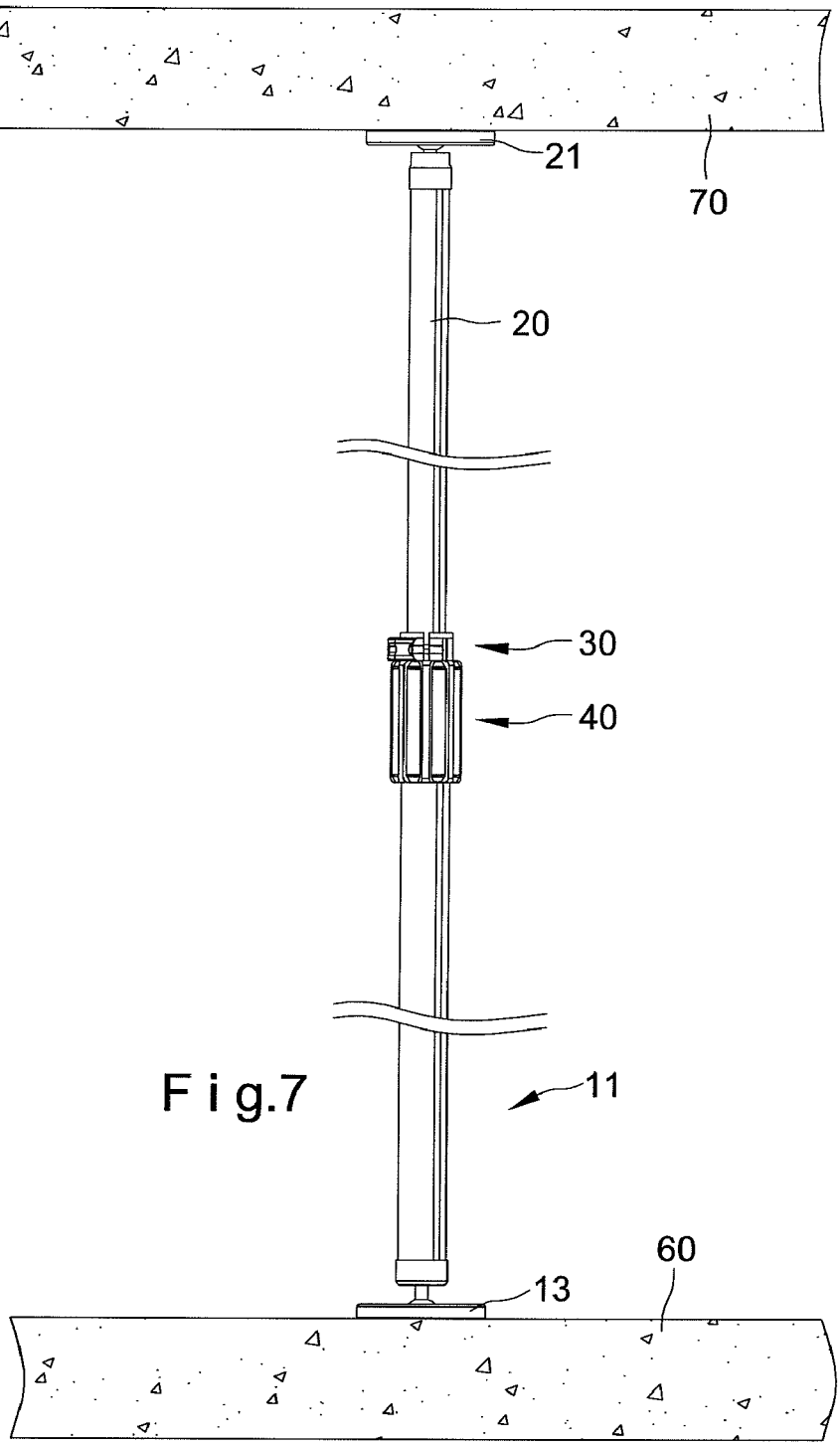
FIG. 7 is a side view showing the telescopically adjustable support brace in support of two objects.

Referring to FIGS. 1 through 6, a telescopically adjustable support brace in accordance with a first embodiment of the present invention includes a first member 10 and a second member 20 that is moveably engaged in the first member 10 and is operably moveable with respect to the first member 10 in a telescopic manner. In the preferred embodiment, the first and second members 10 and 20 are utilized to support two objects 60 and 70 at a fixed distance (as shown in FIG. 7). Additionally, if the fixed distance is changed, the second member 20 is telescopically adjusted in the first member 10 for the distance. Further, the first and second members 10 and 20 may include respective support bases 13 and 21 respectively to enable good frictional engagements with two objects 60 and 70 respectively.

The first member 10 includes an axially extended body 11 and a joining member 12 engaged in the body 11. The body 11 includes an opening 14 at an end thereof, and the joining member 12 includes a connecting section 121 inserted through the opening 14 and received in the body 11 for connection with the body 11. The joining member 12 also includes an engaging section 122 disposed outside the opening 14 of the body 11. Further, an adjusting device 40 includes a coupling section 41 circumferentially coacting with the engaging section 122. Thus, the adjusting device 40 is moveably engaged with the joining member 12. Preferably, the engaging section 122 and coupling sections 41 are formed with threads. The joining member 12 further includes a hole 124 extending therethrough, and the second member 20 can be inserted through the hole 124 and moveably received in the first member 10 thereafter. The hole 124 is coaxial with the body 11.

Figure 9:
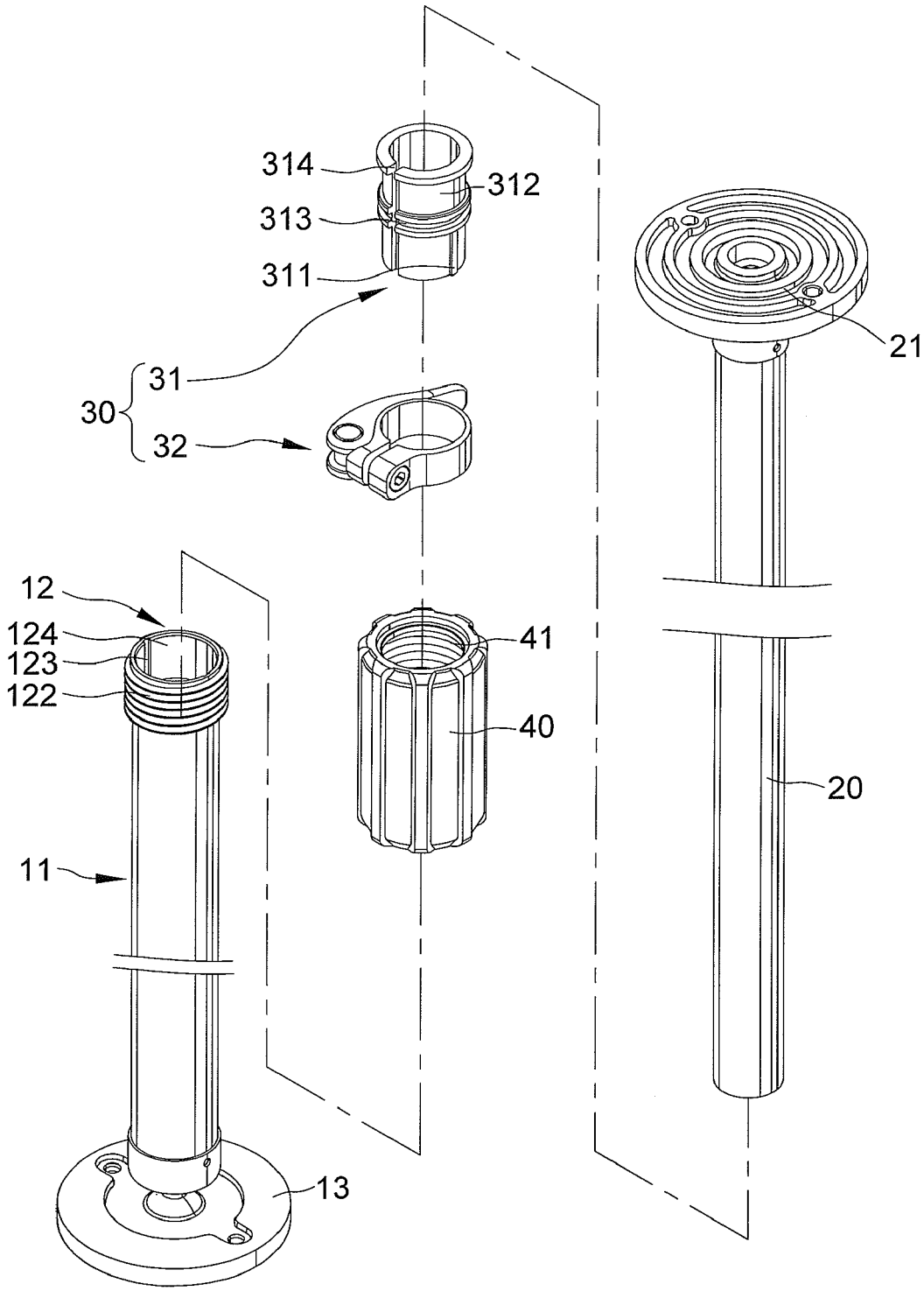
FIG. 9 is an exploded, perspective view of a telescopically adjustable support brace in accordance with an alternate embodiment of the present invention.

In this preferred embodiment, the body 11 and the joining member 12 are releasably connected to one another. However, the body 11 and the joining member 12 are adapted to be formed in one piece, as shown in FIG. 9. If that is the case, the connecting section 121 will thus be eliminated for saving material for the first member 10.

A quick-clamping device 30 includes a collar 31 disposed in the hole 124 of the joining member 12, and the collar 31 includes a through-hole (not numbered) therethrough. The second member 20 can be inserted through the through-hole and moveably received in the first member 10 thereafter. Preferably, the through-hole is coaxial with the hole 124. In the preferred embodiment, the second member 20 is thus adapted to be circumferentially received by the collar 31 first and the joining member 12 next.

Relative rotation of the collar 31 is prevented with respect to the joining member 12 if received in the joining member 12. In the preferred embodiment, the collar 31 includes at least one retaining section 311, and the joining member 12 includes at least one positioning section 123 engaged with the at least one retaining section 311. Preferably, the at least one retaining section 311 is a ridge, and the at least one positioning section 123 is a groove or vice versa.

By rotating the adjusting device in a first direction, the collar 31 can be axially moved out from the joining member 12 of the first member 10. In the preferred embodiment, the collar 31 includes a holding section 313, and the adjusting device 40 includes a connecting section 42 securely engaged in the holding section 313.

The quick-clamping device 30 also includes a quick-release device 32 engaged with an outer periphery 312 of the collar 31. The quick-release device 32 includes a cam abutting against the outer periphery 312 of the collar 31, and the cam is operably moveable to selectively clutch the inner periphery of the collar 31 to the second member 20 such that the collar 31 securely holds the second member 20. In this case, when the collar 31 is moved by the adjusting device 40, the second member 20 is thereafter moved by the collar 31 with respect to the first member 10. For the collar 31 to selectively clutch the inner periphery thereof to the second member 20, the collar 31 may include a slit 314 extending axially on the outer periphery 312 from the proximal end to the distal end thereof.

The adjusting device 40 includes an outer periphery including a friction engaging surface so that the user grips on the engaging surface to operate the adjusting device 40, and the frictional engaging surface enables the user to operate it without slippage.

Figure 8:
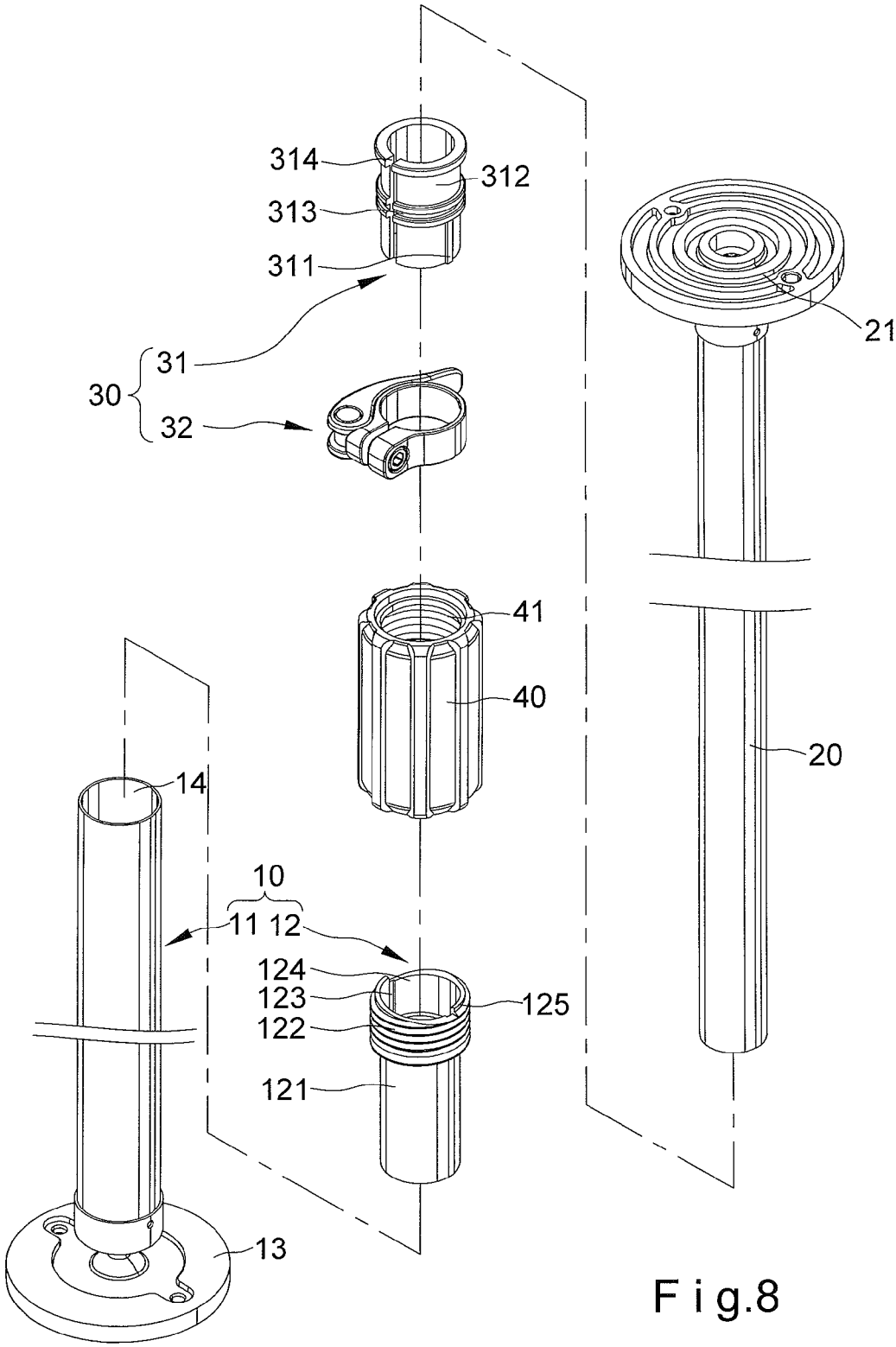
FIG. 8 is a perspective view of a telescopically adjustable support brace in accordance with a second embodiment of the present invention, showing a different first member.

FIG. 8 shows a telescopically adjustable support brace in accordance with a second embodiment of the present invention. In this second embodiment, every component is the same as the first embodiment except that the joining member 12 includes a guiding slope 125 above the engaging section 122 thereof. The guiding slope 125 extends substantially circumferentially in accordance with a top edge of the engaging section 122. Additionally, the guiding slope 125 includes a first end with a first height and a second end with a second height lower than the first height. Preferably, the guiding slope 125 continuously decreases from the first height to the second height. Further, the guiding slope 125 extends from one positioning section 123 and terminates at another positioning section 123. Preferably, if there are two positioning sections 123, two guiding slopes 125 will be formed. The guiding slope 125 is utilized for enabling the collar 31 to be rotated into the hole 124 of the joining member 12 again if it is accidentally rotated out of the hole 124. When the collar 31 is rotated for reengagement in the hole 124, the retaining section 311 of the collar 31 is moveably directed by the guiding slope 125, and once the retaining section 311 is near either the first or the second end of the guiding slope 125, a further rotation to cause the collar 31 to go beyond the first and/or second ends of the guiding slope 125 will cause the retaining section 311 to engage with the positioning section 123.

Based on the forgoing, it is one aspect of the present invention that the telescopically adjustable support brace is readily and finely adjustable.

It is also another aspect of the invention that the telescopically adjustable support brace allows users to adjust the second member 20 with respect to the first member 10 with one hand. Unlike the conventional braces, when the telescopic adjustable support brace of the instant invention is erected upright and the second member 20 is to be statically fixed with respect to the first member 10, a user does not have to use one of his/her hands to fix the second member 20 to the first member 10 while using another of his/her hands to prevent the second member 20 from falling into the first member 10 due to gravity. This is because the quick-clamping device 30 prevents the second member 20 moving relative to the first member 10.

While the specific embodiments have been illustrated and described, numerous modifications come to mind without significantly departing from the spirit of invention and the scope of invention is only limited by the scope of accompanying claims.

What is claimed is:

1. A telescopically adjustable support brace comprising:

a first member including a body extending axially;

a second member moveably engaged in the first member and operably moveable with respect to the first member in a telescopic manner, wherein the body of the first member includes a first end from which the second member is adapted to be inserted;

a quick-clamping device including a collar moveably engaged in the first member, with the collar including an inner periphery surrounding and selectively clutched to an outer periphery of the second member, with a quick-release device engaged with and operable to move the collar between a tightened position such that the inner periphery of the collar is clutched to the second member and the second member is adapted to be moved with respect to the first member by the movement of the collar, and a released position such that the inner periphery of the collar disengages the outer periphery of the second member and the second member is moveable relative to the collar; and an adjusting device engaged with and operable to move the collar with respect to the first member, with a joining member engaged with the body of the first member at the first end, wherein the joining member includes a hole extending therethrough, with an engaging section disposed outside the body and engagable with the adjusting device, wherein the body and the joining member are formed in one piece, and wherein when the collar is in the tightened position, the collar moved by the adjusting device is thereafter adapted to move the second member with respect to the first member.

2. The telescopically adjustable support brace as claimed in claim 1 wherein the adjusting device includes an outer periphery including a friction engaging surface for facilitating a user to operate the adjusting device.

3. The telescopically adjustable support brace as claimed in claim 1 wherein the collar includes an outer periphery for receiving the quick-release device.

4. A telescopically adjustable support brace comprising:

a first member including a body extending axially;

a second member moveably engaged in the first member and operably moveable with respect to the first member in a telescopic manner, wherein the body of the first member includes a first end from which the second member is adapted to be inserted;

a quick-clamping device including a collar moveably engaged in the first member, with the collar including an inner periphery surrounding and selectively clutched to an outer periphery of the second member, with a quick-release device engaged with and operable to move the collar between a tightened position such that the inner periphery of the collar is clutched to the second member and the second member is adapted to be moved with respect to the first member by the movement of the collar, and a released position such that the inner periphery of the collar disengages the outer periphery of the second member and the second member is moveable relative to the collar; and an adjusting device engaged with and operable to move the collar with respect to the first member, with a joining member engaged with the body of the first member at the first end, wherein the joining member includes a hole extending therethrough, with an engaging section disposed outside the body and engagable with the adjusting device, wherein the collar is engaged in the hole of the joining member and disposed between the second member and the joining member, wherein the collar further includes a periphery including a slit extending longitudinally, and wherein when the collar is in the tightened position, the collar moved by the adjusting device is thereafter adapted to move the second member with respect to the first member.

5. The telescopically adjustable support brace as claimed in claim 4 wherein the collar includes a holding section in the form of a groove, and wherein the adjusting device includes a connecting section in the form of a ridge engaged in the holding section, and thereby the collar is moveable under the operation of the adjusting device.

6. A telescopically adjustable support brace comprising:

a first member including a body extending axially;

a second member moveably engaged in the first member and operably moveable with respect to the first member in a telescopic manner, wherein the body of the first member includes a first end from which the second member is adapted to be inserted;

a quick-clamping device including a collar moveably engaged in the first member, with the collar including an inner periphery surrounding and selectively clutched to an outer periphery of the second member, with a quick-release device engaged with and operable to move the collar between a tightened position such that the inner periphery of the collar is clutched to the second member and the second member is adapted to be moved with respect to the first member by the movement of the collar, and a released position such that the inner periphery of the collar disengages the outer periphery of the second member and the second member is moveable relative to the collar; and an adjusting device engaged with and operable to move the collar with respect to the first member, with a joining member engaged with the body of the first member at the first end, wherein the joining member includes a hole extending therethrough, with an engaging section disposed outside the body and engagable with the adjusting device, wherein the joining member includes a positioning section, and wherein the collar includes a retaining section engaged in the positioning section for enabling the collar to move with respect to the joining member without relative rotation therebetween, and wherein when the collar is in the tightened position, the collar moved by the adjusting device is thereafter adapted to move the second member with respect to the first member.

7. A telescopically adjustable support brace comprising:

a first member including a body extending axially;

a second member moveably engaged in the first member and operably moveable with respect to the first member in a telescopic manner, wherein the body of the first member includes a first end from which the second member is adapted to be inserted;

a quick-clamping device including a collar moveably engaged in the first member, with the collar including an inner periphery surrounding and selectively clutched to an outer periphery of the second member, with a quick-release device engaged with and operable to move the collar between a tightened position such that the inner periphery of the collar is clutched to the second member and the second member is adapted to be moved with respect to the first member by the movement of the collar, and a released position such that the inner periphery of the collar disengages the outer periphery of the second member and the second member is moveable relative to the collar; and an adjusting device engaged with and operable to move the collar with respect to the first member, with a joining member engaged with the body of the first member at the first end, wherein the joining member includes a hole extending therethrough, with an engaging section disposed outside the body and engagable with the adjusting device, wherein the engaging section has threads formed thereon, wherein the adjusting device has threads formed thereon and engagable with the threads in the engaging section, and wherein when the collar is in the tightened position, the collar moved by the adjusting device is thereafter adapted to move the second member with respect to the first member.

8. A telescopically adjustable support brace comprising:

a first member including a body extending axially;

a second member moveably engaged in the first member and operably moveable with respect to the first member in a telescopic manner, wherein the body of the first member includes a first end from which the second member is adapted to be inserted;

a quick-clamping device including a collar moveably engaged in the first member, with the collar including an inner periphery surrounding and selectively clutched to an outer periphery of the second member, with a quick-release device engaged with and operable to move the collar between a tightened position such that the inner periphery of the collar is clutched to the second member and the second member is adapted to be moved with respect to the first member by the movement of the collar, and a released position such that the inner periphery of the collar disengages the outer periphery of the second member and the second member is moveable relative to the collar; and an adjusting device engaged with and operable to move the collar with respect to the first member, with a joining member engaged with the body of the first member at the first end, with the joining member includes a hole extending therethrough, with an engaging section disposed outside the body and engagable with the adjusting device, wherein the joining member includes a guiding slope above the engaging section thereof, and wherein when the collar is in the tightened position, the collar moved by the adjusting device is thereafter adapted to move the second member with respect to the first member.

9. The telescopically adjustable support brace as claimed in claim 8 wherein the guiding slope extends substantially circumferentially in accordance with a top edge of the engaging section.

10. The telescopically adjustable support brace as claimed in claim 8 wherein the guiding slope includes a first end with a first height and a second end with a second height lower than the first height, and wherein the guiding slope continuously decreases from the first height to the second height.

11. The telescopically adjustable support brace as claimed in claim 8 wherein the guiding slope extends from one positioning section and terminates at another positioning section.

* * * * *